US008695603B2

(12) United States Patent
Harold et al.

(10) Patent No.: US 8,695,603 B2
(45) Date of Patent: Apr. 15, 2014

(54) FACE MASK WITH TRUNCATED NOSEPIECE

(75) Inventors: Victoria Stan Harold, Edmonton (CA); Christopher Leeuw, Edmonton (CA); Raymond Marusyk, Edmonton (CA); Guy Plamondon, Edmonton (CA)

(73) Assignee: PriMED Medical Products Inc., Edmonton (CA)

( * ) Notice: Subject to any disclaimer, the term of this patent is extended or adjusted under 35 U.S.C. 154(b) by 0 days.

(21) Appl. No.: 13/386,654

(22) PCT Filed: Jul. 22, 2009

(86) PCT No.: PCT/CA2009/001041

§ 371 (c)(1), (2), (4) Date: Jan. 23, 2012

(87) PCT Pub. No.: WO2011/009188

PCT Pub. Date: Jan. 27, 2011

(65) Prior Publication Data

US 2012/0234327 A1 Sep. 20, 2012

(51) Int. Cl.

| | |
|---|---|
| ***A62B 7/10*** | (2006.01) |
| ***A62B 7/00*** | (2006.01) |
| ***A62B 23/00*** | (2006.01) |
| ***A62B 18/02*** | (2006.01) |
| ***A41D 13/11*** | (2006.01) |

(52) U.S. Cl.

USPC ..... 128/207.11; 128/206.28; 128/206.21; 128/206.12; 128/205.29; 128/200.24

(58) Field of Classification Search

CPC ..... A61M 16/0683; A61M 16/06; A61M 2016/0633; A61M 16/0666; A61M 2210/0618; A61M 16/0816; A61M 16/105; A61M 16/12; A61M 16/208; A61M 16/0465; A61M 16/0488; A61M 16/0875; A61M 16/1045; A61M 2016/0018; A61M 2016/0027;A61M 2016/0039; A61M 2016/0661; A61M 2016/102; A61M 2016/142; A61M 2205/3368; A61M 2205/35; A61M 2205/502; A61M 2205/52; A61M 2205/581; A61M 2205/582; A61M 2205/583; A61M 2205/588; A61M 2205/8206; A61M 2205/8212; A61M 2209/088; A61M 2230/202; A61M 2230/43; A61M 2230/432; A61M 2230/63; A61M 2240/02; A62B 23/025; A62B 18/084; A62B 18/025; A62B 18/02; A62B 18/086; A62B 18/10; A62B 23/06

USPC ..... 128/857, 863, 200.24, 201.17, 201.25, 128/205.25, 205.27, 205.29, 128/206.11–206.19, 206.21, 206.23, 128/206.24, 206.27, 206.28, 207.11, 207.13

See application file for complete search history.

(56) References Cited

U.S. PATENT DOCUMENTS

| | | | |
|---|---|---|---|
| 2,281,744 | A | 5/1942 | Brunner |
| 3,603,315 | A | 9/1971 | Becker, III |

(Continued)

FOREIGN PATENT DOCUMENTS

| | | | |
|---|---|---|---|
| CA | 2 213 332 | A1 | 9/1996 |
| CA | 2 253 800 | C | 12/1997 |

(Continued)

*Primary Examiner* — Annette Dixon

(74) *Attorney, Agent, or Firm* — Christensen O'Connor Johnson Kindness PLLC

(57) ABSTRACT

A face mask which has a fabric body of folded filter material that defines an expandable face pocket, an interior face, an exterior face, a top edge, a bottom edge and opposed side edges. A bendable strip of metal defines a nosepiece that is centrally positioned between the opposed side edges along the top edge. The nosepiece has a length that is not less than 3.50 cm and not more than 6.00 cm, and a width that is not less than 0.30 cm and not more than 2.00 cm. Straps are used to secure the fabric body to a person's head.

2 Claims, 2 Drawing Sheets

(56) References Cited

U.S. PATENT DOCUMENTS

| | | | |
|---|---|---|---|
| 3,971,369 | A | 7/1976 | Aspelin |
| 4,014,047 | A | 3/1977 | Zobel |
| 4,084,585 | A | 4/1978 | Venaleck |
| 4,300,549 | A | 11/1981 | Parker |
| 4,662,005 | A | 5/1987 | Grier-Idris |
| 4,688,566 | A | 8/1987 | Boyce |
| 5,107,547 | A | 4/1992 | Scheu |
| 5,322,061 | A | 6/1994 | Brunson |
| 5,553,608 | A | 9/1996 | Reese |
| 5,694,925 | A | 12/1997 | Reese |
| 5,699,791 | A | 12/1997 | Sukiennik |
| 5,699,792 | A | 12/1997 | Reese |
| 5,701,893 | A | 12/1997 | Kern |
| 5,724,964 | A | 3/1998 | Brunson |
| 5,735,270 | A | 4/1998 | Bayer |
| 6,055,982 | A | 5/2000 | Brunson |
| 6,098,201 | A | 8/2000 | Boros, Sr. |
| 6,098,624 | A | 8/2000 | Utamaru |
| 6,173,712 | B1 | 1/2001 | Brunson |
| 6,332,465 | B1 | 12/2001 | Xue |
| 6,536,434 | B1 | 3/2003 | Bostock |
| 6,886,563 | B2 | 5/2005 | Bostock |
| 6,928,657 | B2 | 8/2005 | Bell |
| 7,036,507 | B2 | 5/2006 | Jensen |
| 7,069,930 | B2 | 7/2006 | Bostock |
| 7,766,015 | B2 | 8/2010 | Harold |
| 2004/0069302 | A1 | 4/2004 | Wilson |
| 2005/0051172 | A1 | 3/2005 | Lee |
| 2005/0098180 | A1 | 5/2005 | Lien |
| 2005/0133034 | A1 | 6/2005 | Jensen |
| 2005/0133036 | A1 | 6/2005 | Steindorf |
| 2006/0130842 | A1 | 6/2006 | Kleman |
| 2006/0137691 | A1 | 6/2006 | Kleman |
| 2007/0044803 | A1 * | 3/2007 | Xue et al. ..... 128/206.21 |
| 2007/0068529 | A1 * | 3/2007 | Kalatoor et al. ..... 128/206.19 |

FOREIGN PATENT DOCUMENTS

| | | | |
|---|---|---|---|
| CA | 2 335 287 | A1 | 12/1999 |
| CA | 2 426 149 | A1 | 8/2002 |
| CA | 2 549 789 | A1 | 12/2006 |
| EP | 0 934 704 | A2 | 8/1999 |
| EP | 1 529 453 | A2 | 5/2005 |
| GB | 2 045 093 | A | 10/1980 |
| GB | 2 329 128 | A | 3/1999 |
| JP | 2006-305279 | A | 11/2006 |
| JP | 2006-345996 | A | 12/2006 |
| WO | 81/03266 | A1 | 11/1981 |
| WO | 01/43828 | A1 | 6/2001 |

* cited by examiner

FACE MASK WITH TRUNCATED NOSEPIECE

CROSS-REFERENCE TO RELATED APPLICATION

The present application is a national stage entry of International Application No. PCT/CA2009/001041, filed Jul. 22, 2009.

FIELD

The field of this invention relates to fabric face masks that are used by medical personnel, construction workers, dog groomers and others to filter contaminants.

BACKGROUND

Many fabric face masks use thin bands of metal called "nosepieces" or "nosewires" to provide rigidity to the fabric. The nosepieces generally extend for the entire width of the face mask. An example of such a face mask is U.S. Pat. No. 5,699,791 (Sukiennik et al).

In theory, nosepieces can readily be bent to conform to contours of a persons face and promote a better fit. However, upon reviewing results of leakage tests, the Applicant has reached the conclusion that conventional nosepieces actually contribute to leakage as the wearer breathes in and out, which has lead to the Applicant seeking a face mask construction with an alternative form of nosepiece.

SUMMARY

There is provided a face mask that has a fabric body of folded filter material defining an expandable face pocket. For purposes of orientation, the body can be said to have an interior face, an exterior face, a top edge, a bottom edge and opposed side edges. A bendable strip of metal defines a nosepiece. The nosepiece is centrally positioned between the opposed side edges along the top edge. For reasons that will hereinafter be more fully explained, it has a length that is not less than 3.50 cm and not more than 6.00 cm, with a width that is not less than 0.30 cm and not more than 2.00 cm. Straps are used to secure the fabric body to a person's head.

The theory behind this face mask is that a stable anchor in the vicinity of the nose is the key to obtaining a fit with less leakage. As will hereinafter be further described, the masks generally come in small, medium and large sizes. Consistent with all sizes is a nosepiece that bends to fit the contours of the nose. It is to believed that the nosepiece is critical to maintaining a seal to prevent leakage as the wearer breathes in and out. When the length of the nosepiece is less than 3.50 cm, the nosepiece does not properly engage the nose and, therefore, does not provide the desired anchor. It also is prone to leakage. When the length of the nosepiece exceeds 6.00 cm, it extends beyond the natural creases along the nose and onto the cheeks. It has been found that although there may initially be a seal, as soon as the wearer talks or makes a facial expression, the seal is lost. A length of less than 6.00 cm engages the nose, without creating this leakage problem. The width of the nosepiece is equally important. When the width is less than 0.30 cm, there is insufficient rigidity to engage the nose and maintain a seal. When the width is greater than 2.00 cm, the nosepiece becomes too rigid and leakage occurs under the nosepiece.

Once the problem of anchoring to the nose was solved, different methods of securing the bottom edge and opposed side edges of the body were tried, Superior results were obtained when an elastomeric strip under tension was extended from a strap anchoring point one third of a distance down one of the opposed sides, along the bottom edge to an opposed strap anchoring point two thirds of a distance up another of the opposed sides. It is to be noted that the elastomeric strip is under tension. This exerts a biasing three upon the body to draw the expandable face pocket into a wearer's face along the bottom edge and the opposed side edges.

The preferred positions for attaching the straps to the body are at the strap anchoring point and the opposed strap anchoring point. It has been found to simplify the manufacturing process when a one piece construction is used, with the straps merely being extensions of the elastomeric strip.

BRIEF DESCRIPTION OF THE DRAWINGS

These and other features will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 1:
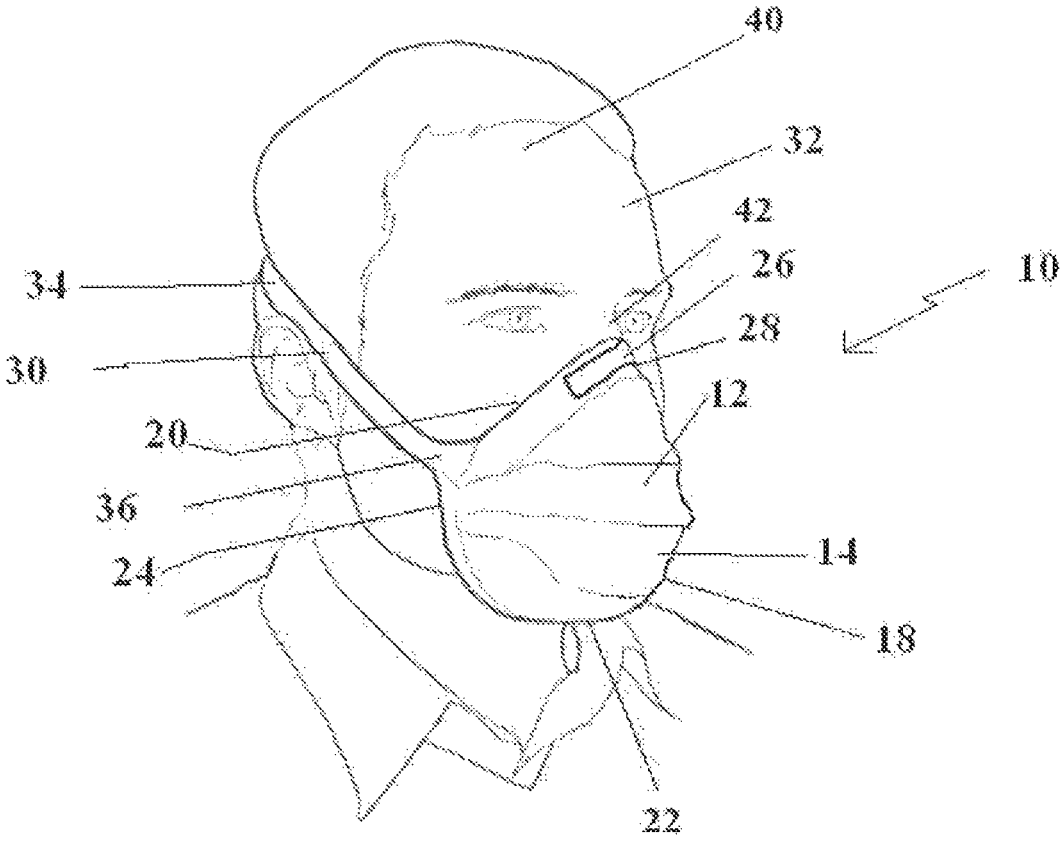
FIG. 1 is a perspective front view of a face mask constructed in accordance with the teachings of the present invention, as worn by a person.

A face mask, generally identified by reference numeral 10, will now be described with reference to FIG. 1 through 2.

Structure and Relationship of Parts

Figure 2:
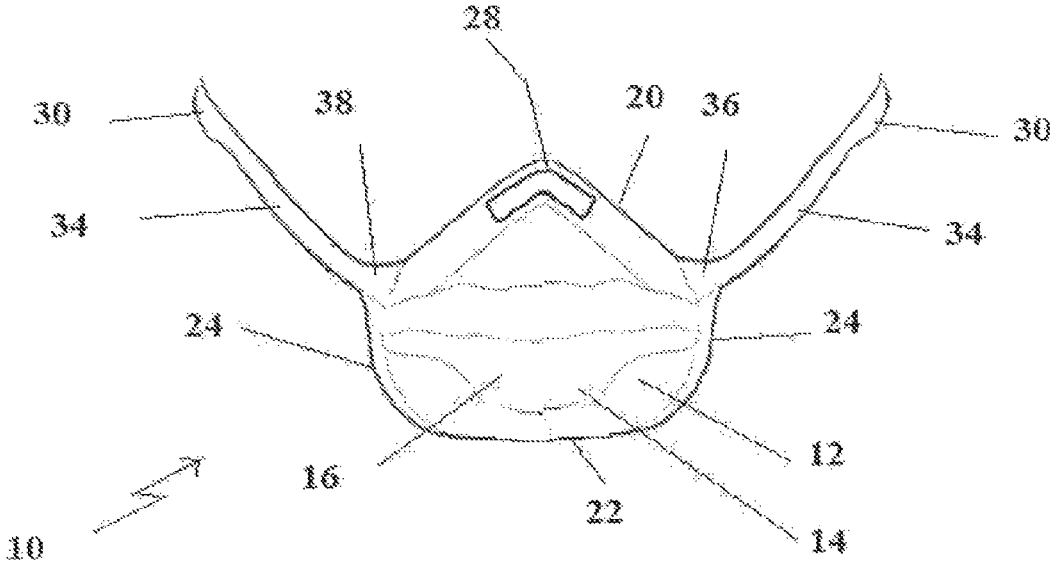
FIG. 2 is a back view of the face mask illustrated in FIG. 1.

Referring to FIG. 1, there is provided a face mask 10, which has a fabric body 12 of folded filter material defining, an expandable face pocket 14. Fabric body 12 has an interior face 16 as illustrated in FIG. 2, and an exterior face 18 as illustrated in FIG. 1. Referring to FIG. 1, fabric body also has atop edge 20, a bottom edge 22 and opposed side edges 24. A bendable strip of metal 26 defines a nosepiece 28. Nosepiece 28 is centrally positioned between opposed side edges 24 along top edge 20 and has a length that is not less than 3.50 cm and not more than 6.00 cm. Nosepiece 28 also has a width that is not less than 0.30 cm and not more than 2.00 cm. Straps 30 are provide to secure fabric body 12 to a person's head 32.

An elastomeric strip 34 under tension extends from a strap anchoring point 36 one third of the distance down one of opposed sides 24 and along bottom edge 22 to an opposed strap anchoring point 38 two thirds of the distance up another of opposed sides 24. Straps 30 are secured to strap anchoring point 36 and opposed strap anchoring point 38 and are integrally formed extensions of elastomeric strip 34. Referring to FIG. 2, in the illustrated embodiment, there are two straps 30 which are intended to be tied together around a person's head 32 as illustrated in FIG. 1, however, there could also be a single strap which extends from anchoring point 36 and opposed strap anchoring point 38 that stretches over a person's head 32 to hold it in position.

Operation

Face mask 10 is worn over a face 40 of person's head 32 as illustrated in FIG. 1 to filter contaminants. Nosepiece 28 bends to fit the contours of a nose 42. Nosepiece 28 is critical to maintaining a seal to prevent leakage as the wearer breathes in and out. The length and width of nosepiece 28 serves to properly engage nose 42 and provide the desired anchor thereby preventing leakage. An example of suitable length and width is provided below.

As elastomeric strip 34 is under tension, it exerts a biasing force upon the body 12 to draw the expandable face pocket 14 into a wearer's face 40 along the bottom edge 22 and the opposed side edges 24. Referring to FIG. 2, the preferred positions for attaching the straps 30 to body 12 are at the strap anchoring point 36 and the opposed strap anchoring point 38. It has been found to simplify the manufacturing process when a one piece construction is used, with straps 30 merely being extensions of elastomeric strip 34.

Examples

A face can be categorized as small, medium or large. The length of a person's face is determined by the menton-sellion length, extending from the top of the bridge of the nose to the bottom of the chin. The width of a person's face is determined by the bi-zygomatic breadth, which is the distance between the zygomatic arches. Although the broad working range has been described above, best mode in small, medium and large is considered to be as follows:

Small

Length 4 cm×Width 0.75 cm.

Medium

Length 5 cm×Width 1.00 cm

Large

Length 6 cm×Width 1.5 cm

What is claimed is:

1. A face mask, comprising:

a non-woven body having pleated folds of filter material defining an expandable face pocket, an interior face, an exterior face, a top edge, a bottom edge and opposed side edges;

a flat bendable strip of metal defining a nosepiece, the nosepiece extending through the body and centrally positioned between the opposed side edges along the top edge and having a length that is not less than 3.50 cm and not more than 6.00 cm, with a width that is not less than 0.30 cm and not more than 2.00 cm;

straps secured to strap anchoring points, the strap anchoring points being positioned one third of a distance down from the top edge along the opposed side edges of the body, the straps extending away from the side edges starting at the strap anchoring points; and a continuous elastomeric strip under tension extending through the body from one of the strap anchoring points down one of the opposed side edges, along the bottom edge and up another of the opposed sides edges to another of the strap anchoring points to draw in the bottom edge and the opposed side edges.

2. The face mask of claim 1, wherein the straps are integrally formed extensions of the elastomeric strip.

* * * * *